US005150945A

United States Patent [19]

Aupperlee et al.

[11] Patent Number: 5,150,945

[45] Date of Patent: Sep. 29, 1992

[54] VEHICULAR CHILD SEAT COVER

[76] Inventors: Patricia C. Aupperlee, 5961 St. Barbara St., West Palm Beach, Fla. 33415; Beth R. Wiswell, 1702 12th Ct. N., Lake Worth, Fla. 33460

[21] Appl. No.: 684,783

[22] Filed: Apr. 15, 1991

[51] Int. Cl.[5] ..... A47C 7/62

[52] U.S. Cl. ..... 297/184; 297/219; 297/224; 297/220; 297/229

[58] Field of Search ..... 297/184, 219, 224, 229, 297/220, 221; 224/275

[56] References Cited

U.S. PATENT DOCUMENTS

| | | | |
|---|---|---|---|
| 3,279,849 | 10/1966 | Radke et al. | 297/DIG. 6 X |
| 4,206,945 | 6/1980 | Kifferstein | 297/397 X |
| 4,273,380 | 6/1981 | Silvestri | 297/229 X |
| 4,362,334 | 12/1982 | Ross et al. | 297/DIG. 6 X |
| 4,383,713 | 5/1983 | Roston | 297/397 X |
| 4,478,453 | 10/1984 | Schutz | 297/219 |
| 4,553,785 | 11/1985 | Duke, Jr. et al. | 297/229 |
| 4,579,385 | 4/1986 | Koenig | 297/184 |
| 4,583,779 | 4/1986 | Meyers | 297/184 |
| 4,725,094 | 2/1988 | Greer | 297/220 X |
| 4,761,032 | 8/1988 | Sanchez | 297/229 |
| 4,784,426 | 11/1988 | Mannisto-Iches | 296/97.7 |
| 4,785,838 | 11/1988 | Negahdari | 135/117 |
| 4,790,592 | 12/1988 | Busso et al. | 297/184 |
| 4,807,927 | 2/1989 | Livick | 297/184 |
| 4,877,288 | 10/1989 | Lee | 297/220 X |
| 4,946,221 | 8/1990 | Livingston | 297/184 |
| 4,978,166 | 12/1990 | James | 297/184 |

FOREIGN PATENT DOCUMENTS

| | | | |
|---|---|---|---|
| 3844078 | 7/1990 | Fed. Rep. of Germany | 297/184 |
| 10754 | of 1910 | United Kingdom | 297/219 |

*Primary Examiner*—James R. Brittain
*Assistant Examiner*—Milton Nelson, Jr.
*Attorney, Agent, or Firm*—Alvin S. Blum

[57] ABSTRACT

A vehicular safety seat for a child may be exposed to the sun to such an extent that certain portions will be hot enough to burn a child. A removeable cover is provided that covers all areas of the seat when unoccupied. Because the cover must be applied and removed while holding the child, special structure is provided so that these tasks may be performed with one hand. A combined storage pouch/pillow is attached to the upper or backrest portion of the cover. While the upper portion of the cover remains attached to the safety seat, the balance of the cover may be removed from the seat and stuffed into the pouch with one hand to form a soft pillow for the child's head. The position of the pouch may be adjusted on the cover to accomodate the child's growth. The balance of the cover may be removed from the pouch and applied to completely cover the child seat with one hand. There are no problems with misplacing the cover since the upper portion remains attached to the child seat in both the covered and uncovered mode. Arrangements for holding the cover in place on the child seat are provided.

3 Claims, 1 Drawing Sheet

VEHICULAR CHILD SEAT COVER

BACKGROUND OF THE INVENTION

This invention relates to child seats of the type mandated by law to safely support young children in motor vehicles, and more particularly to an improved cover for such child seats.

Child seats of the type for which the cover of the invention is intended vary widely in design and construction. They are all characterized by a seat and back portion and a supporting base therefor. Most seats have restraining bars or straps to hold the child in place and the supporting base is held in place on the vehicle seat by a seat belt. The seat portion is often plastic for easy cleaning and the bars, buckles and the like may have portions made of metal.

The metal and plastic materials of the child seat may become so extremely hot if left exposed to the sun, or even when left in a vehicle exposed to sunlight, as to burn the sensitive skin of the child. The experience may so traumatize the child as to engender a phobia against vehicles.

For this reason, a variety of covers for infant seats have been devised. These are examplified by U.S. Pat. Nos. 4,761,032 issued Aug. 2, 1988 to Sanchez et al and 4,478,453 issued Oct. 23, 1984 to Schutz. Covers of the prior art generally do not make provisions for disposition of the cover when not in use. Since deploying and removing of the cover will generally be performed while holding the child with one hand, it would be desirable to have a cover that may be operated with one hand.

The child seats of the art do not make adequate provision for adjusting the backrest for maximum comfort as the child grows.

SUMMARY OF THE INVENTION

It is accordingly an object of the invention to provide a protective cover for a vehicular child seat that can be readily deployed for covering the seat with one hand. It is another object of the invention to provide storage means for the cover when the seat is uncovered and providing for uncovering the seat with one hand. It is yet another object of the invention to provide storage means for the cover that remain attached to the seat in the form of a pouch that is vertically adjustable on the seat to serve as a pillow for the child.

The cover of the invention remains attached at its upper end to the backrest of the child seat. When deployed, the cover extends down over the entire upper surface of the child seat and its restraining means to protect them from the heat of the sun. Attached to the outer surface of the backrest portion of the cover is a pouch/ pillow. This is removably attached so that it can be raised as the child grows. When the child is to be placed in the seat, the portions of the cover below the pouch are pulled off the seat and stuffed into the pouch where they are ready for use and where they provide stuffing for the pillow function. The unsoiled, underside of the cover is thereby turned to the outside as it covers the pillow.

These and other objects, advantages and features of the invention will become more apparent when the detailed description is studied in conjunction with the drawings.

DETAILED DESCRIPTION OF PREFERRED EMBODIMENT

Figure 1:
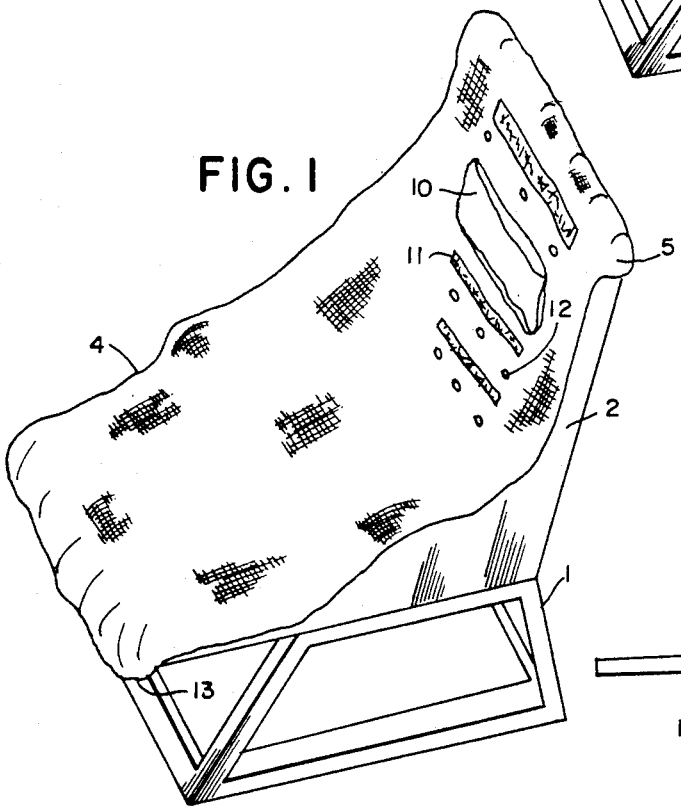
FIG. 1 is a perspective view of the cover in place and covering a child's seat.
Figure 3:
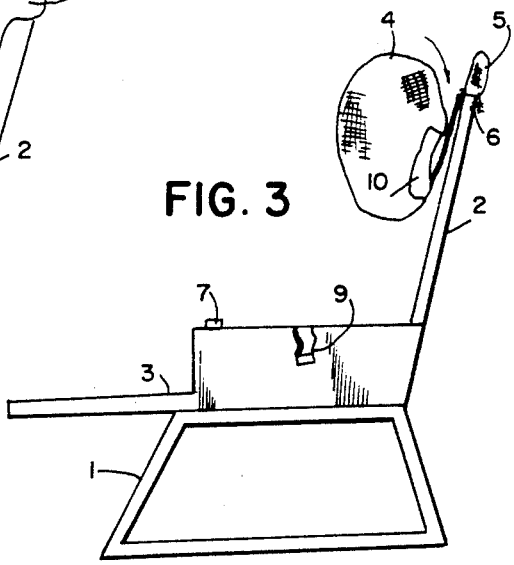
FIG. 3 is a side view of the cover in place on a seat being stuffed into the pillow.

Referring now first to FIGS. 1 and 3, a vehicular child seat 1 has a back 2 and seat portion 3. The cover 4 of the invention has an elasticized upper hem that forms a snug fitting sleeve top 5 to fit a variety of backs 2 without adjustment. The cover may be removably attached to the seat back 2 by attaching means such as matching hook-and-loop fasteners 6, one member of which is cemented to the seat so that the cover may be removed for cleaning. When opened, the cover extends over the entire back 2 and seat portion 3, completely covering the surfaces that would touch the child including any restraining bars 7 or belt buckles 9 that are often metal that can more readily cause burns. A pouch/pillow 10 is removably attached to the outer surface of the cover by hook and loop fastening means 11 or snaps 12. These are positioned at a series of levels, so that the pillow may be raised as the child grows, thereby providing an adjustment of the seat configuration for more comfortable seating. The bottom hem 13 of the cover is also elasticed for enhanced fitting to the bottom of seats of different sizes and shapes.

Figure 2:
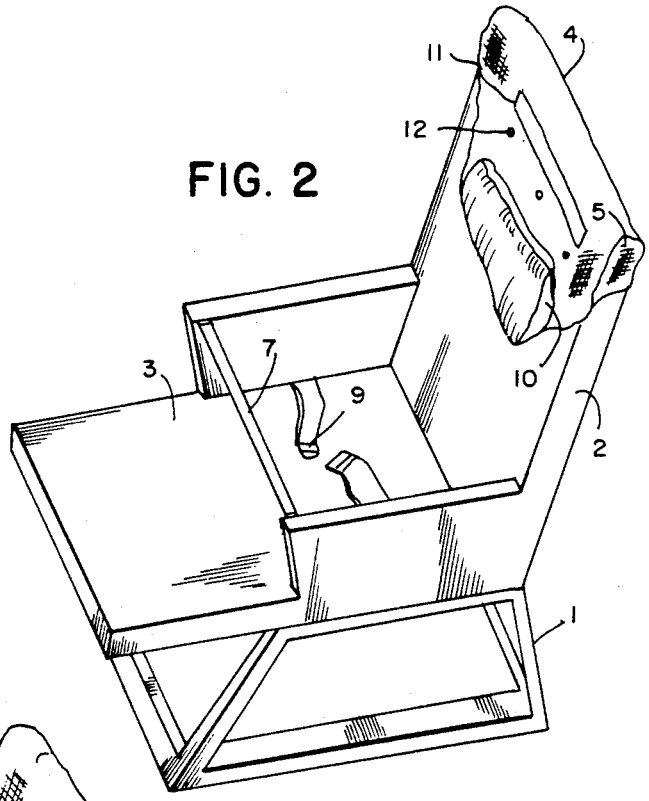
FIG. 2 is a perspective view of the cover in place with seat uncovered and pillow stuffed.

When the seat is to be uncovered, the bottom hem is pulled free and, as best seen in FIGS. 2 and 3, stuffed into the pouch/pillow 10 until substantially all of the cover below pillow level is stuffed into the pillow. The sides of the pouch may be elasticized for enhanced performance. The cover is now out of the way and the child may be placed in the seat without fear of burning because all the surfaces that may contact the child's body had been covered. Furthermore, the cover kept them clean. And the surface of the pillow that had been exposed to soiling is now covered, with the surface exposed to the child's head being the underside of the cover. Any dirt or dust that may have settled on the cover is now on the surface in contact with the pouch and away from the child. The cover may be fabricated from one or more layers of any of a variety of materials both functional and decorative, as desired including sheet fabric, sheet plastic, plastic coated fabric and the like. It can be seen that the cover of the invention, once installed on a child's seat 1 and fastened at the rear by fasteners 6, can be easily operated with one hand to cover or uncover the car seat, while holding the child with the other hand. The surfaces in contact with the child are kept clean and there is never any posibility of exposing the child on the seat to the dirty outer surface of the cover. The pouch/pillow has a top opening and closed bottom and elasticized sides, it forms a convenient storage means of ready access and adds a comfort element that adjusts to the child's growth.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A removable cover assembly for a vehicular child's seat of the type having a backrest with a top edge and a sitting portion with a bottom edge and an exterior surface provided for direct contact with a seated child, the cover assembly preventing soiling or overheating of the exterior surface of the child's seat when unoccupied and being removable with one hand for occupation by the child, said cover assembly comprising:

a) an elongate flexible panel having a head end, a lower end and an intermediate section therebetween, said panel dimensioned to cover the entire outer surface of the child's seat and accessories thereto, said lower end provided with a stretchable band for stretching over the bottom edge of the child's seat and said head end provided with engagement means for engaging the top edge of the child's seat;

b) a fabric pouch having a top margin, two sides, a broad outer face sheet and a broad under face sheet, said top margin having an opening therein extending substantially to said two sides, said opening providing access to a chamber defined by said two sides and the two said face sheets;

c) adjustable support means connected to the under face sheet of said pouch for supporting said pouch at adjustable distances below the top edge of the child's seat to rest beneath the head of a child of a particular size when seated on the seat;

d) said cover assembly provided with two modes of operation relative to the seat, a covered mode for use when the seat is unoccupied, in which the seat is completely covered from sun and soil by said panel with said head end engaging the top edge of the seat and the lower end engaging the bottom edge of the seat and the intermediate section covering the seat and accessories and an uncovered mode for use when the seat is to be occupied by a child, in which said lower end is disengaged from the bottom edge of the seat and stuffed into the chamber of said pouch together with the portion of the intermediate section of the panel that was below the level of the pouch in the covered mode, thereby exposing the clean and cool exterior surface of the seat for contact with the child and the stuffed pouch serving as a pillow at head level and as a storage means for a portion of the panel; and e) said pouch and panel being arranged for changing between said two modes of operation with one hand, said lower end being readily released and engaged by said stretchable band and said head end having engagement means secure enough to remain engaged to the top edge of the seat while changing from one mode to another, said engagement means including a first member of a set of hook-and-loop fastening means affixed to said head end with a second member of said set of hook-and-loop fastening means arranged for attachment to the top of the backrest of a child's seat.

2. The cover assembly according to claim 1, in which said adjustable support means connected to said pouch are one of a pair of hook and loop fastening means and the other of said pair of fastening means are attached to the outer surface of said panel.

3. The cover assembly according to claim 1, in which said engagement means further includes an elasticized top margin of said head end for snugly engaging the upper edge of child's seats of different shapes and sizes.

* * * * *